US005934821A

United States Patent [19]

Shaw et al.

[11] Patent Number: 5,934,821

[45] **Date of Patent: *Aug. 10, 1999**

[54] CONCRETE DOWEL PLACEMENT APPARATUS

[76] Inventors: Lee A. Shaw, 2672 Crestview Dr., Newport Beach, Calif. 92663; Ronald D. Shaw, 1401 Outrigger, Corona Del Mar, Calif. 92625

[ * ] Notice: This patent is subject to a terminal disclaimer.

[21] Appl. No.: 08/865,880

[22] Filed: May 30, 1997

Related U.S. Application Data

[63] Continuation-in-part of application No. 08/572,153, Nov. 11, 1995.

[51] Int. Cl.[6] ..... E04B 1/62; E01C 11/16

[52] U.S. Cl. ..... 404/62; 404/74; 404/88; 52/396.02; 52/298; 52/704

[58] Field of Search ..... 52/396.02, 396.03, 52/396.08, 704, 706, 296, 298; 14/73.1; 404/48, 51, 56, 59, 60, 62, 63, 65, 70, 134, 135, 136, 74, 88

[56] References Cited

U.S. PATENT DOCUMENTS

| | | | |
|---|---|---|---|
| 1,045,562 | 11/1912 | Kennedy . | |
| 1,592,681 | 7/1926 | Grothe . | |
| 1,838,635 | 12/1931 | Pilj . | |
| 1,852,673 | 4/1932 | Pilj . | |
| 1,939,007 | 12/1933 | Heltzel | 25/118 |
| 2,095,060 | 10/1937 | Geyer | 94/18 |
| 2,129,568 | 9/1938 | De Biasi | 72/122 |
| 2,262,704 | 11/1941 | Tompkins et al. | 72/128 |
| 2,277,203 | 3/1942 | Boult | 94/24 |
| 2,296,453 | 9/1942 | Saffert | 25/155 |
| 2,319,526 | 5/1943 | Wearn | 72/128 |
| 2,331,949 | 10/1943 | Whiteman | 72/128 |
| 2,365,550 | 12/1944 | Heltzel | 94/18 |
| 2,373,284 | 4/1945 | Autrey | 72/128 |
| 2,508,443 | 5/1950 | Carter | 94/18 |
| 2,636,426 | 4/1953 | Heltzel | 94/51 |
| 2,746,365 | 5/1956 | Darneille | 94/33 |
| 2,823,539 | 2/1958 | Kersh et al. | 72/128 |
| 3,066,448 | 12/1962 | Pinter | 50/80 |
| 3,284,973 | 11/1966 | Ames et al. | 52/155 |
| 3,333,380 | 8/1967 | Wolf | 52/365 |
| 3,451,179 | 6/1969 | Kendzia | 52/370 |

(List continued on next page.)

FOREIGN PATENT DOCUMENTS

| | | |
|---|---|---|
| 79813 | 8/1955 | Denmark . |
| 568457 | 10/1975 | Switzerland . |

OTHER PUBLICATIONS 3 page document entitled Continuous Dowel Support and Spacer.

9 page document from Portland Cement Association entitled Finishing Concrete Slabs, Exposed Aggregate, Patterns and Colors.

33 page document from Portland Cement Association entitled Color & Texture.

*Primary Examiner*—James A. Lisehora

*Attorney, Agent, or Firm*—Stetina Brunda Garred & Brucker

[57] ABSTRACT

A concrete dowel placement apparatus comprising a base member and an elongate, tubular dowel receiving sheath which is connectible to the base member. The base member comprises an outer sleeve having first and second ends and a flange portion which extends about the first end of the outer sleeve and defines front and back surfaces and a peripheral edge. The base member further comprises an inner sleeve which is disposed within the outer sleeve and defines an aperture extending longitudinally therethrough to the back surface of the flange portion. Extending between the inner and outer sleeves is at least one reinforcement wall. The sheath has an open proximal end, a closed distal end, and a hollow interior compartment extending longitudinally therein. The open proximal end of the sheath is extensible over the outer sleeve such that at least a portion of the outer sleeve resides within the interior compartment.

38 Claims, 4 Drawing Sheets

U.S. PATENT DOCUMENTS

| | | | |
|---|---|---|---|
| 3,896,599 | 7/1975 | Werstein et al. | 52/704 |
| 3,920,221 | 11/1975 | Berry et al. | 256/59 |
| 3,921,356 | 11/1975 | Hughes | 52/299 |
| 4,115,976 | 9/1978 | Rohrer | 52/741 |
| 4,158,937 | 6/1979 | Henry | 52/365 |
| 4,437,828 | 3/1984 | Egger | 425/458 |
| 4,496,504 | 1/1985 | Steenson et al. | 264/69 |
| 4,533,112 | 8/1985 | Santos, Jr. et al. | 249/3 |
| 4,578,916 | 4/1986 | Witschi | 52/396 |
| 4,614,070 | 9/1986 | Idland | 52/296 |
| 4,648,739 | 3/1987 | Thomsen | 404/2 |
| 4,752,153 | 6/1988 | Miller | 404/59 |
| 4,800,702 | 1/1989 | Wheeler | 52/677 |
| 4,899,497 | 2/1990 | Madl, Jr. | 52/126.6 |
| 4,926,593 | 5/1990 | Johnston | 52/126.4 |
| 4,938,631 | 7/1990 | Maechtle et al. | 52/235 |
| 4,959,940 | 10/1990 | Witschi | 52/583 |
| 5,005,331 | 4/1991 | Shaw et al. | 52/396 |
| 5,134,828 | 8/1992 | Baur | 52/704 |
| 5,212,919 | 5/1993 | Shaw et al. | 52/126.6 |
| 5,216,862 | 6/1993 | Shaw et al. | 52/396 |
| 5,301,485 | 4/1994 | Shaw et al. | 52/678 |
| 5,678,952 | 10/1997 | Shaw et al. . | |

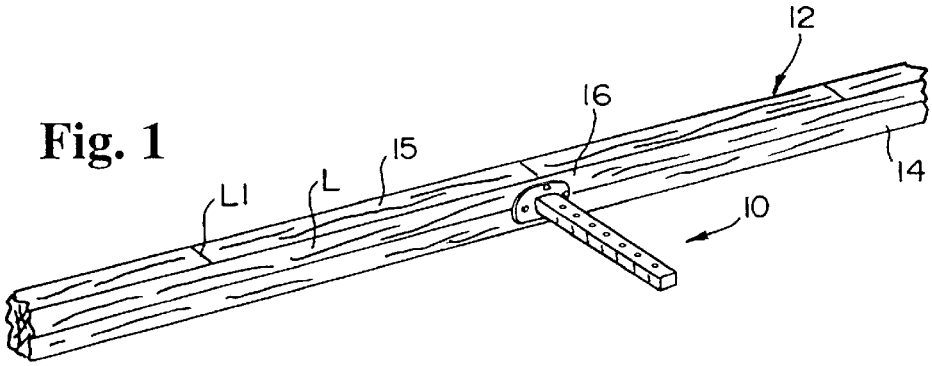
Fig. 1
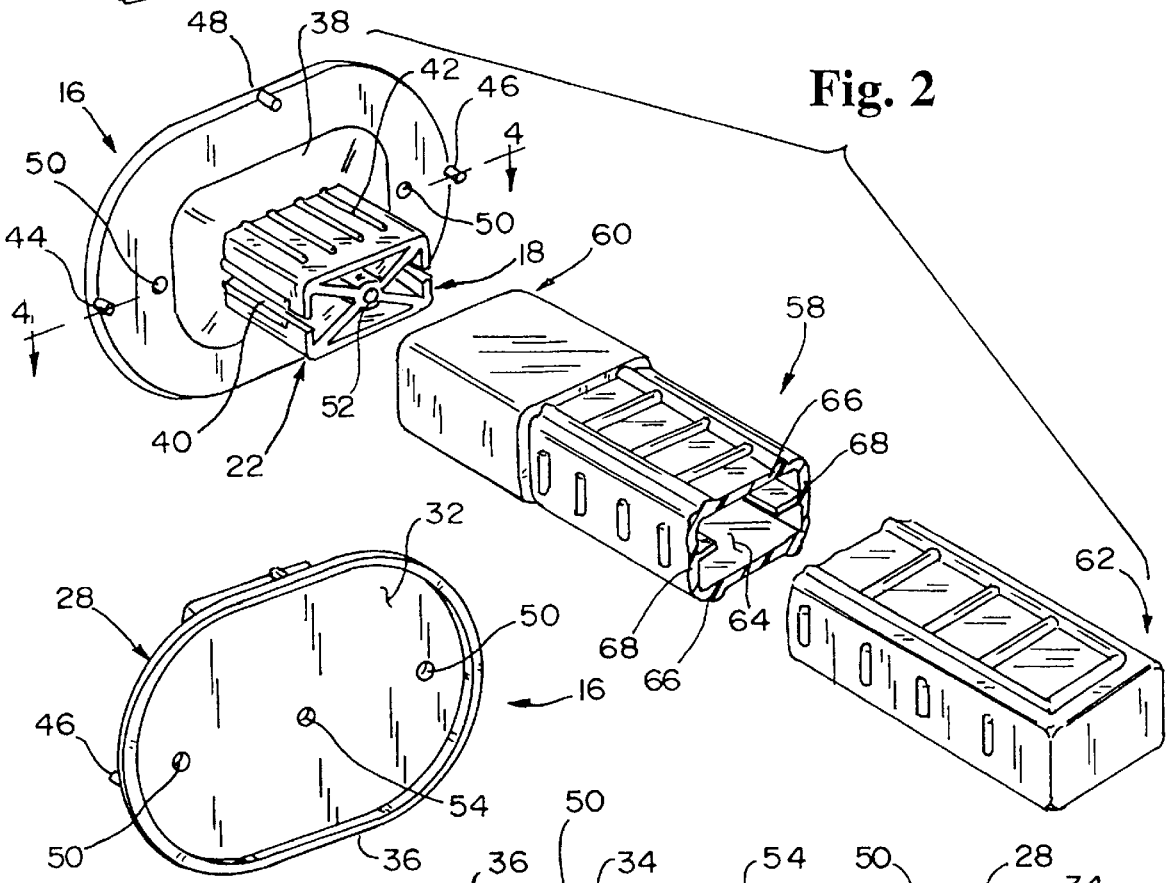
Fig. 2
Fig. 3
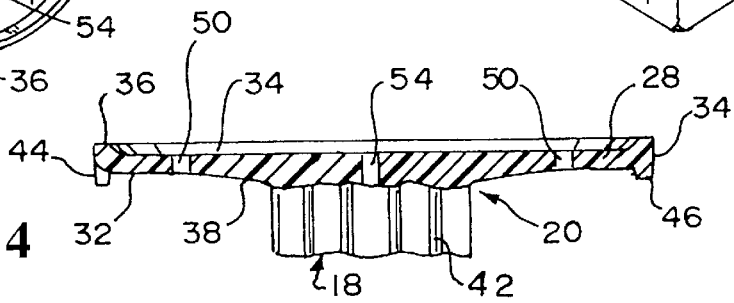
Fig. 4

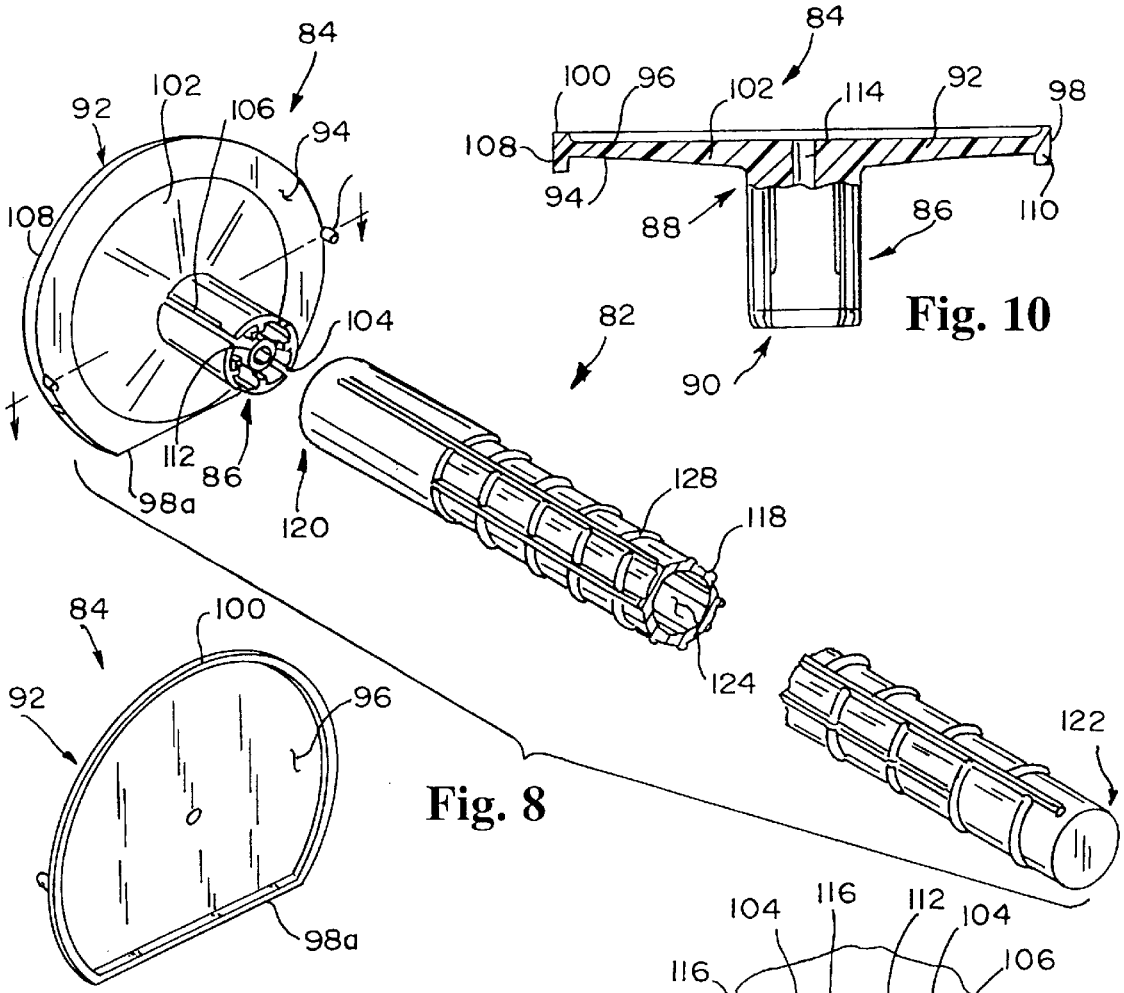
Fig. 10
Fig. 8
Fig. 9
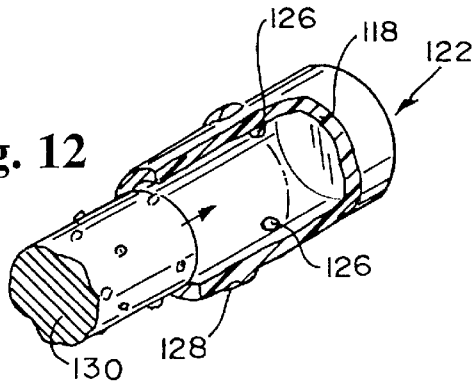
Fig. 12
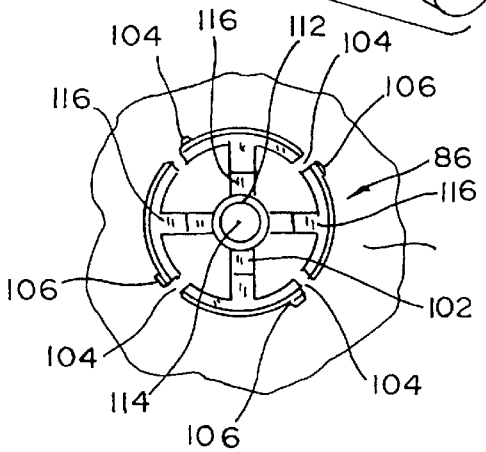
Fig. 11

CONCRETE DOWEL PLACEMENT APPARATUS

RELATED APPLICATION

The present application is a continuation-in-part of U.S. application Ser. No. 08/572,153 entitled CONCRETE DOWEL PLACEMENT APPARATUS filed Nov. 11, 1995, the disclosure of which is incorporated herein by reference.

FIELD OF THE INVENTION

The present invention relates generally to the art of concrete construction, and more particularly to devices for facilitating the placement of slip dowel rods within adjacent concrete slabs.

BACKGROUND OF THE INVENTION

In the art of concrete construction, it is commonplace to form "cold joints" between two or more poured concrete slabs. Such cold joints frequently become uneven or buckled due to normal thermal expansion and contraction of the concrete and/or compaction of the underlying soil caused by inadequate substrate preparation prior to pouring of the concrete. As a means of preventing buckling or angular displacement of such cold joints, it is common practice to insert smooth steel dowel rods generally known as "slip dowels" within the edge portions of adjoining concrete slabs in such a manner that the concrete slabs may slide freely along one or more of the slip dowels, thereby permitting linear expansion and contraction of the slabs while at the same time maintaining the slabs in a common plane and thus preventing undesirable bucking or unevenness of the cold joint.

In order to function effectively, slip dowels must be accurately positioned parallel within the adjoining concrete slabs. The non-parallel positioning of the dowels will prevent the desired slippage of the dowels and will defeat the purpose of the "slip dowel" application. Additionally, the individual dowels must be placed within one or both of the slabs in such a manner as to permit continual slippage or movement of the dowels within the cured concrete slab(s).

In the prior art, two methods of installing smooth "slip dowels" have become popular. According to the first method, a first concrete pour is made within a pre-existing form. After the first pour has cured, an edge of the form (usually a wooden stud) is stripped away. A series of holes are then drilled parallel into the first pour along the exposed edge from which the form has been removed. The depth and diameter of the individual holes varies depending on the application and the relative size of the concrete slabs to be supported. As a general rule, however, such holes are at least 12 inches deep and typically have a diameter of approximately five-eighths of an inch.

After the parallel aligned series of holes has been drilled into the first pour, smooth dowel rods are advanced into each such hole such that one end of each dowel rod is positioned within the first pour and the remainder of each dowel rod extends into a neighboring area where a second slab of concrete is to be poured. Thereafter, concrete is poured into such neighboring area and is permitted to set with the parallel aligned dowels extending thereinto. After the second pour has set, the slip dowels will be held firmly within the second slab but will be permitted to slide longitudinally within the drilled holes of the first slab thereby accommodating longitudinal expansion and contraction of the two slabs while at the same time preventing buckling or angular movement therebetween.

Although the above described "drilling method" of placing slip dowels has become popular, it will be appreciated that such method is extremely labor intensive. In fact, it takes approximately ten minutes to drill a five-eighths inch diameter by twelve inches long hole into the first pour, and the drilling equipment, bits, accessories, and associated set up time tends to be very expensive. Moreover, the laborers who drill the holes and place the slip dowels must be adequately trained to insure that the dowels are arranged perpendicular to the joint but parallel to one another so as to permit the desired slippage during subsequent use.

The second popular method of placing slip dowels involves the use of wax treated cardboard sleeves positioned over one end of each individual dowel. According to such method, a series of holes are drilled through one edge of a concrete form and smooth dowels are advanced through each such hole. Wax treated cardboard sleeves are placed over one end of each dowel and the first pour is made within the form. After the first pour has set, the previously drilled form is stripped away leaving the individual dowels extending into a neighboring open space where the second pour is to be made. Subsequently, the second pour is made and permitted to cure. Thereafter, the slip dowels will be firmly held by the concrete of the second pour but will be permitted to longitudinally slide against the inner surfaces of the wax treated cardboard sleeves within the first pour. Thus, the waxed cardboard sleeves facilitate longitudinal slippage of the dowels, while at the same time holding the two concrete slabs in a common plane, and preventing undesirable buckling or angular movement thereof.

This second method, while presently popular, is nonetheless associated with numerous deficiencies. For example, after the first pour has been made, the free ends of the dowels are likely to project as much as eighteen inches through the forms and into the open space allowed for the second pour. Because the drilled section of form must be advanced over those exposed sections of dowel to accomplish stripping or removal of the form, it is not infrequent for the exposed portions of the dowels to become bent and, thus, nonparallel. Also, the drilled section of form may become damaged or broken during the removal process, thereby precluding its reuse.

It is unfortunate that both of the above-described popular methods of placing slip dowels often result in the dowels being finally positioned at various angles rather than in the desired parallel array. When such occurs, the necessary slippage of the dowels is impeded or prevented.

There is also known in the prior art dowel placement devices which comprise elongate, hollow tubes sized to receive portions of the dowel rods. The tubes are mounted to one edge of the concrete form in generally parallel relation to each other via integral base portions, with a first pour being made thereabout. After the first pour has cured, the edge of the concrete form to which the tubes are mounted is stripped away from the first slab, with dowel rods being advanced into the exposed open ends of the tubes embedded within the first slab. Those portions of the dowel rods not advanced into the tubes extend into a neighboring area where a second pour of concrete is to be made. The pouring of the concrete into the neighboring area encapsulates the dowel rods which are held firmly within the second slab formed by the curing of the second pour. The dowels, though being firmly held within the second slab, are permitted to slide longitudinally within the tubes embedded in the first slab.

Though the use of these prior art placement devices presents advantages over the previously described placement methods, these devices also possess certain deficiencies which detract from their overall utility. In particular, the attachment of the base portions of these prior art placement devices to a concrete form often requires the use of multiple fasteners, which makes the attachment process a difficult and time-consuming task. Additionally, in the prior art placement devices both the tube and its integral base portion used to facilitate the connection of the tube to the concrete form are embedded in the first slab, thus necessitating that additional placement devices be attached to the concrete form prior to its reuse.

Accordingly, there remains a need in the art for methods and/or devices for facilitating the proper placement of slip dowels which overcome the previously described deficiencies associated with prior art placement devices.

SUMMARY OF THE INVENTION

In accordance with a first embodiment of the present invention, there is provided a concrete dowel placement apparatus comprising a base member having an outer sleeve which defines first and second ends and has a generally rectangular cross-sectional configuration. More particularly, the outer sleeve defines opposed pairs of lateral and longitudinal sides which have outer surfaces and are separated by respective ones of four (4) corner regions. Extending about the first end of the outer sleeve is a generally oval-shaped flange portion which defines a front surface, a substantially flat back surface, and a peripheral edge. Disposed within respective ones of the lateral sides of the outer sleeve is a pair of slots which extend longitudinally from the front surface of the flange portion to the second end of the outer sleeve. Additionally, formed on the outer surfaces of the lateral and longitudinal sides of the outer sleeve are a plurality of ribs which extend longitudinally to the front surface of the flange portion. Formed on the back surface of the flange portion is a raised bead which extends about the peripheral edge thereof. Further, formed on the front surface of the flange portion about the first end of the outer sleeve is a reinforcement region of increased thickness.

The base member further comprises first, second and third locator pegs which are formed on the front surface of the flange portion adjacent the peripheral edge thereof. The first and second locator pegs are oriented upon a first axis which bisects the lateral sides and slots of the outer sleeve, with the third locator sleeve being oriented upon a second axis which bisects the longitudinal sides of the outer sleeve. Additionally, disposed within and extending through the flange portion is a pair of apertures which are oriented upon the first axis between the lateral sides of the outer sleeve and respective ones of the first and second locator pegs.

The base member of the placement apparatus of the first embodiment also includes an inner sleeve which has a generally circular cross-sectional configuration and is centrally positioned within the outer sleeve. The inner sleeve defines an aperture which extends longitudinally therethrough to the back surface of the flange portion. The aperture also extends to the second end of the outer sleeve, with the inner sleeve being spaced from the outer sleeve. Extending between the inner and outer sleeves are four (4) reinforcement walls. In particular, the reinforcement walls extend in a generally X-shaped pattern between the inner sleeve and respective ones of the corner regions of the outer sleeve.

In addition to the base member, the placement apparatus of the first embodiment comprises an elongate dowel receiving sheath which has an open proximal end, a closed distal end, and a hollow interior compartment extending longitudinally therein. Extending longitudinally within the interior compartment in opposed relation to each other is a pair of crush ribs. Also disposed within the interior compartment in close proximity to the closed distal end of the sheath is an opposed pair of stop members. In the placement apparatus, the sheath, and in particular the interior compartment thereof, has a configuration which is complementary to that of the outer sleeve. In this respect, the open proximal end of the sheath is extensible over the outer sleeve such that at least a portion of the outer sleeve resides within the interior compartment of the sheath. When the sheath is extended over the outer sleeve of the base member, the crush ribs are received into respective ones of the slots within the lateral sides of the outer sleeve. Both the base member and the sheath of the placement apparatus of the first embodiment are preferably fabricated from a plastic material.

In accordance with a second embodiment of the present invention, there is provided a concrete dowel placement apparatus comprising a base member which includes an outer sleeve having a generally circular cross-sectional configuration and defining first and second ends and an outer surface. Extending about the first end of the outer sleeve is a flange portion which defines a front surface, a substantially flat back surface, and a peripheral edge. The flange portion has a generally circular configuration including a flat portion formed in the peripheral edge thereof. Disposed within the outer sleeve in equidistantly spaced intervals of approximately 90 degrees are four (4) slots which extend longitudinally to the second end of the outer sleeve. Additionally, formed on the outer surface of the outer sleeve are a plurality of ribs which extend longitudinally to the front surface of the flange portion. Formed on the back surface of the flange portion is a raised bead which extends about the peripheral edge thereof, while formed on the front surface of the flange portion about the first outer sleeve is a reinforcement region of increased thickness. The base member also includes a pair of locator pegs which are formed on the front surface of the flange portion adjacent the peripheral edge thereof and on opposite sides of the outer sleeve.

The base member of the placement apparatus of the second embodiment further comprises an inner sleeve which has a generally circular cross-sectional configuration and is concentrically positioned within the outer sleeve. The inner sleeve defines an aperture which extends longitudinally therethrough to the back surface of the flange portion. The aperture also extends to the second end of the outer sleeve, with the inner sleeve being spaced from the outer sleeve. Extending between the inner and outer sleeves are four (4) reinforcement walls which are spaced in intervals of approximately 90 degrees, and are centrally positioned between respective pairs of the slots disposed within the outer sleeve.

The placement apparatus of the second embodiment also includes an elongate dowel receiving sheath having an open proximal end, a closed distal end, and a hollow interior compartment extending longitudinally therein. The interior compartment of the sheath has a configuration which is complementary to that of the outer sleeve of the base member, with the open proximal end of the sheath being extensible over the outer sleeve such that at least a portion of the outer sleeve resides within the interior compartment. Disposed within the interior compartment of the sheath in close proximity to the closed distal end thereof is an opposed pair of stop members. The base member and sheath of the placement apparatus of the second embodiment are each preferably fabricated from a plastic material.

In accordance with a third embodiment of the present invention, there is provided a concrete dowel placement apparatus comprising a base member which has the structural attributes of the base member described in relation to the second embodiment. In addition to the base member, the placement apparatus of the third embodiment comprises an elongate sheath which has an open proximal end, a closed distal end, and a hollow interior compartment extending longitudinally therein. The sheath also has a generally circular cross-sectional configuration, and is of gradually increasing diameter as it extends from the open proximal end to the closed distal end. Additionally, the proximal portion of the interior compartment of the sheath has a configuration which is complementary to that of the outer sleeve of the base member, which the open proximal end of the sheath being extensible over the outer sleeve such that at least a portion of the outer sleeve resides within the interior compartment. The base member of the placement apparatus of the third embodiment is also preferably fabricated from a plastic material, with the sheath preferably being fabricated from steel, and more particularly stainless steel.

Further in accordance with the present invention, there is provided a method of extending a dowel rod through a joint between adjacent concrete slabs. The method comprises the initial step of providing a base member which includes an outer sleeve, a flange portion extending about the first end of the outer sleeve, an inner sleeve disposed within the outer sleeve and defining an aperture which extends longitudinally therethrough to the back surface of the flange portion, and at least one reinforcement wall extending between the inner and outer sleeves. The method further comprises the step of attaching the base member to a concrete form such that the outer sleeve protrudes therefrom. In particular, the back surface of the flange portion of the base member is placed into abutting contact with the concrete form, with a fastener such as a nail being extending through the aperture of the inner sleeve and into the concrete form which is typically fabricated from wood.

In addition to the above-described steps, the method comprises providing a dowel receiving sheath having an open proximal end, a closed distal end, and a hollow interior compartment extending longitudinally therein. The open proximal end of the sheath is extended over the outer sleeve of the base member such that at least a portion of the outer sleeve resides within the interior compartment of the sheath. Thereafter, a first pour of concrete is made within the concrete form about the sheath, with the base member being removed from within the sheath subsequent to the curing of the first pour into a first slab. A dowel rod is then inserted into the open proximal end of the sheath which is disposed within the edge of the first slab formed by the curing of the first pour, with a generally U-shaped clip being placed over the dowel rod in a manner covering the remaining portion of the open proximal end of the sheath. Finally, a second pour of concrete is made within the concrete form about the exposed portion of the dowel rod protruding from the sheath. As such, the dowel rod extends through the joint formed between the first slab and the second slab formed by the curing of the second concrete pour.

BRIEF DESCRIPTION OF THE DRAWINGS

These, as well as other features of the present invention, will become more apparent upon reference to the drawings wherein:

FIG. 1 is a front perspective view of a concrete dowel placement apparatus constructed in accordance with a first embodiment of the present invention as attached to a section of a concrete form;

FIG. 2 is an exploded view of the placement apparatus of the first embodiment;

FIG. 3 is a rear perspective view of the base member of the placement apparatus of the first embodiment;

FIG. 4 is a cross-sectional view taken along line 4—4 of FIG. 2;

FIG. 8 is an exploded view of a concrete dowel placement apparatus constructed in accordance with a second embodiment of the present invention;

FIG. 9 is a rear perspective view of the base member of the placement apparatus of the second embodiment;

FIG. 10 is a cross-sectional view taken along line 10—10 of FIG. 8;

FIG. 11 is a top plan view of the inner and outer sleeves and reinforcement walls of the base member of the placement apparatus of the second embodiment;

FIG. 12 is a partial cut-away perspective view of the sheath of the placement apparatus of the second embodiment, further illustrating the manner in which a dowel rod is inserted thereinto;

DETAILED DESCRIPTION OF THE PREFERRED EMBODIMENTS

Figure 5:
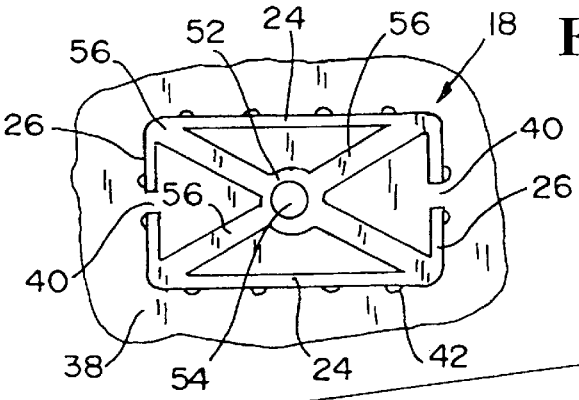
FIG. 5 is a top plan view of the inner and outer sleeves and reinforcement walls of the base member of the placement apparatus of the first embodiment.

Referring now to the drawings wherein the showings are for purposes for illustrating preferred embodiments of the present invention only, and not for purposes for limiting the same, FIG. 1 perspectively illustrates a concrete dowel placement apparatus 10 constructed in accordance with a first embodiment of the present invention, the structural features of which are shown in FIGS. 1–7. As will be discussed in more detail below, the placement apparatus 10 of the first embodiment is typically attached to a segment of a wooden concrete form 12, and more particularly to one of the vertically oriented, longitudinal sides 14 of the concrete form 12.

Referring now to FIGS. 2–5, the placement apparatus 10 of the first embodiment comprises a base member 16 which is preferably fabricated from a plastic material. The base member 16 itself comprises an outer sleeve 18 which has a generally rectangular cross-sectional configuration and defines a proximal first end 20 and a distal second end 22. More particularly, the outer sleeve 18 defines an opposed pair of longitudinal sides 24 and an opposed pair of lateral sides 26. The longitudinal and lateral sides 24, 26 are integrally connected to each other by four (4) rounded corner regions of the outer sleeve 18.

Referring now to FIGS. 2–4, integrally connected to and extending about the first end 20 of the outer sleeve 18 is a generally oval-shaped flange portion 28 which defines a front surface 30, a substantially flat back surface 32, and a continuous peripheral edge 34. Formed on the back surface 32 of the flange portion 28 is a raised bead 36 which extends about the peripheral edge 34. Additionally, formed on the front surface 30 of the flange portion 28 about the first end 20 of the outer sleeve 18 is a reinforcement region 38 of increased thickness.

As seen in FIGS. 2 and 5, centrally positioned within respective ones of the lateral sides 26 of the outer sleeve 18 is a pair of slots 40 which extend longitudinally from the second end 22 of the outer sleeve 18 to the first end 20 thereof (i.e., to the reinforcement region 38 of the flange portion 28). Additionally, formed on the outer surfaces of the longitudinal and lateral sides 24, 26 in spaced, generally parallel relation to each other are a plurality of elongate ribs 42 which extend longitudinally from the reinforcement region 38 of the flange portion 28 and terminate slightly proximally from the second end 22 of the outer sleeve 18.

As further seen in FIGS. 2–4, formed on the front surface 30 of the flange portion 28 adjacent the peripheral edge 34 is a first locator peg 44, a second locator peg 46, and a third locator peg 48. The first and second locator pegs 44, 46 are oriented upon a first axis which bisects the lateral sides 26 and slots 40 of the outer sleeve 18, with the third locator peg 48 being oriented upon a second axis which bisects the longitudinal sides 24 of the outer sleeve 18. Additionally, disposed within and extending through the flange portion 28 is a pair of apertures 50 which are also oriented upon the first axis between the lateral sides 26 of the outer sleeve 18 and respective ones of the first and second locator pegs 44, 46. The apertures 50 are oriented upon the first axis outwardly beyond the reinforcement region 38 of the flange portion 28.

The base member 16 of the placement apparatus 10 further comprises an inner sleeve 52 which has a generally circular cross-sectional configuration and is centrally positioned within the outer sleeve 18 (i.e., is disposed in spaced relation to the longitudinal and lateral sides 24, 26 of the outer sleeve 18). The inner sleeve 52 defines an aperture 54 which extends longitudinally therethrough to the back surface 32 of the flange portion 28. Additionally, the inner sleeve 52 is sized such that the aperture 54 extends to the second end 22 of the outer sleeve 18. As best seen in FIGS. 2 and 5, extending between the inner sleeve 52 and respective ones of the corner regions of the outer sleeve 18 are four (4) reinforcement walls 56 of the base member 16 which are arranged in a generally X-shaped pattern. Both the inner sleeve 52 and reinforcement walls 56, like the outer sleeve 18, are integrally connected to the flange portion 28.

Figure 6:
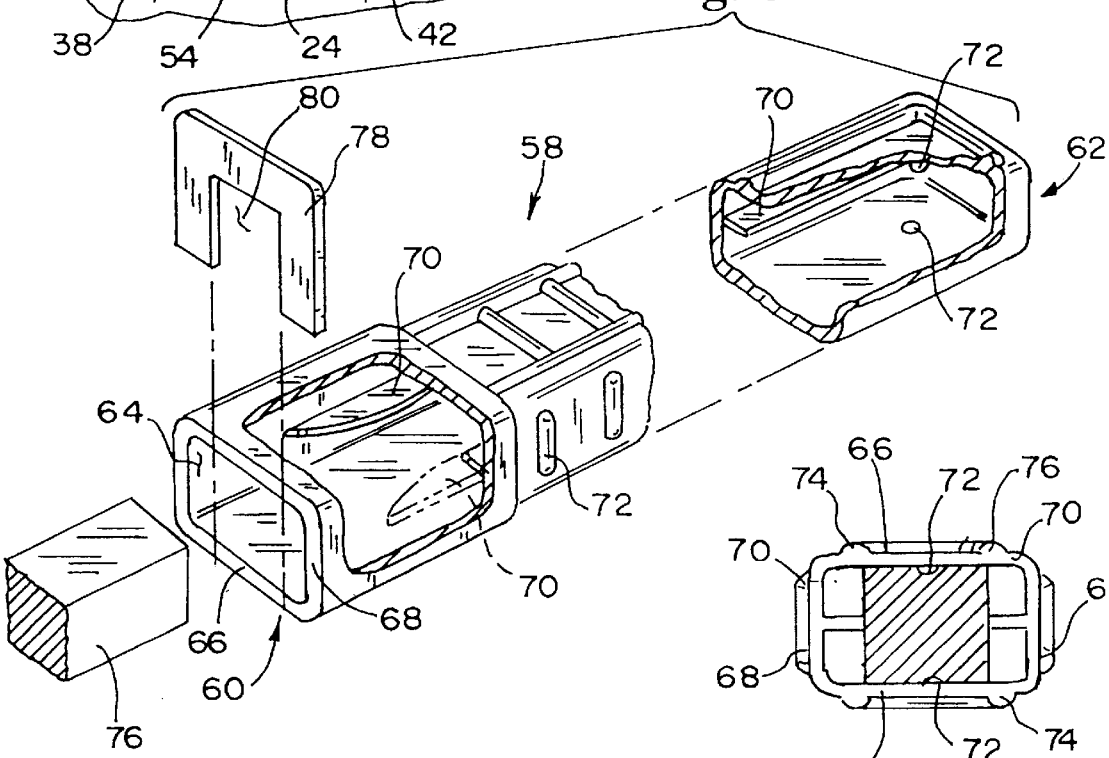
FIG. 6 is a partial cut-away perspective view of the sheath of the placement apparatus of the first embodiment, further illustrating the manner in which a dowel rod and sealing clip are used in conjunction therewith.
Figure 7:
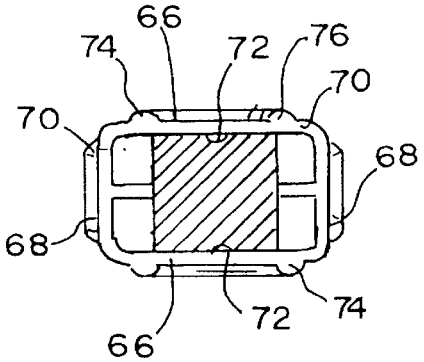
FIG. 7 is a cross-sectional view of the sheath of the placement apparatus of the first embodiment, further illustrating the orientation of the dowel rod therewithin subsequent to being inserted thereinto.

Referring now to FIGS. 2, 6 and 7, in addition to the base member 16, the placement apparatus 10 of the first embodiment further comprises an elongate dowel receiving sheath 58 which has a generally rectangular cross-sectional configuration and includes an open proximal end 60, a closed distal end 62, and a hollow interior compartment 64 extending longitudinally therein. Due to its rectangular cross-sectional configuration, the sheath 58 defines an opposed pair of longitudinal sides 66 and an opposed pair of lateral sides 68. Formed and centrally positioned on the inner surfaces of respective ones of the lateral sides 68 is a pair of elongate crush ribs 70 which extend longitudinally within the interior compartment 64 in opposed relation to each other. As seen in FIG. 6, the crush ribs 70 have arcuately contoured proximal ends which terminate inwardly from the open proximal end 60 of the sheath 58. Formed on the inner surfaces of respective ones of the longitudinal sides 66 in opposed relation to each other and in relative close proximity to the closed distal end 62 of the sheath 58 is a pair of stop members 72. The sheath 58 further includes raised ribs 74 formed on the outer surfaces of substantial portions of the longitudinal and lateral sides 66, 68 thereof. However, the outer surface portions of the longitudinal and lateral sides 66, 68 adjacent the open proximal end 60 of the sheath 58 are devoid of the ribs 74 and have generally smooth configurations. The sheath 58, like the base member 16, is preferably fabricated from a plastic material.

In the placement apparatus 10, the sheath 58 is extensible over the outer sleeve 18 of the base member 16 such that at least a portion of the outer sleeve 18 resides within the interior compartment 64 of the sheath 58. In this respect, the interior compartment 64 has a configuration which is complementary to that of the outer sleeve 18, thus allowing the open proximal end 60 of the sheath 58 to be slidably advanced over the outer sleeve 18. When the sheath 58 is extended over the outer sleeve 18, the crush ribs 70 are received into respective ones of the slots 40 of the outer sleeve 18. Typically, the sheath 58 is advanced over the outer sleeve 18 until such time as the open proximal end 60 is abutted against the front surface 30 of the flange portion 28, and more particularly the reinforcement region 38 circumventing the first end 20 of the outer sleeve 18.

Once attached to the base member 16 in the aforementioned manner, the sheath 58 is frictionally maintained thereon, with such frictional retention being aided by the interference of the ribs 42 of the outer sleeve 18 with the inner surfaces of the longitudinal and lateral sides 66, 68 of the sheath 58. Additionally, the inclusion of the slots 40 within the lateral sides 26 of the outer sleeve 18 allows the longitudinal sides 24 to flex slightly inwardly toward each other when the sheath 58 is advanced over the outer sleeve 18. In this respect, the outward biasing force exerted by the inwardly flexed longitudinal sides 24 against the sheath 58 further assists in the frictional retention of the sheath 58 upon the outer sleeve 18 of the base member 16.

Referring now to FIG. 1, the placement apparatus 10 is used by initially securing the base member 16 to the longitudinal side 14 of the concrete form 12. Prior to such attachment, the base member 16 is "centered" upon the longitudinal side 14, with such centering being accomplished by aligning the first and second locator pegs 44, 46 with a chalk line L which is applied to and longitudinally bisects the longitudinal side 14 of the concrete form 12. Confirmation that the first and second locator pegs 44, 46 are aligned with the chalk line L is achieved through the observation of the chalk line L within the apertures 50 of the flange portion 28. Once the base member 16 has been centered upon the longitudinal side 14, a fastener such as a nail is extended through the aperture 54 of the inner sleeve 52 and into the wooden concrete form 12. Due to the inner sleeve 52 being centrally positioned within and spaced from the outer sleeve 18, any blunting of the distal end of the inner sleeve 52 which occurs as the nail is being driven into the concrete form 12 does not result in any distortion of the outer sleeve 18 as would adversely affect the ability to slidably advance the sheath 58 thereover. The reinforcement walls 56 assist in maintaining the structural integrity of the base member 16 as the nail is drawn into the concrete form 12. Though not required, subsequent to the advancement of a first nail through the aperture 54 into the concrete form 12, a second nail may be advanced through one of the apertures 50 into the concrete form 12 for purposes of preventing any rotation of the base member 16 upon the concrete form 12 in the event the nail extended through the aperture 54 loosens.

In the placement apparatus 10, both the base member 16 and sheath 58 are preferably fabricated via an injection molding process. Due to such method of fabrication, it is difficult to form the back surface 32 of the flange portion 28 with a perfectly flat configuration. As such, the inclusion of the raised bead 36 upon the back surface 32 about the peripheral edge 34 assists in achieving substantial abutting contact between the base member 16 and the concrete form 12 when the base member 16 is initially oriented upon the longitudinal side 14 along the chalk line L. As will be recognized, when the raised bead 36 is initially placed against the longitudinal side 14 of the concrete form 12, the back surface 32 of the flange portion 28 is disposed in spaced relation to the longitudinal side 14. The extension of the nail through the aperture 54 and into the concrete form 12 in the aforementioned manner causes the central portion of the back surface 32 of the flange portion 28 to be bowed outwardly into contact with the longitudinal side 14 of the concrete form 12. Thus, even if the back surface 32 is not substantially flat, the flange portion 32 will have at least two points of contact with the longitudinal side 14 of the concrete form 12 when the base member 16 is secured thereto (i.e., the raised bead 36 and the outwardly bowed center region of the back surface 32). The inclusion of the reinforcement region 38 with the flange portion 28 maintains the structural integrity of the base member 16 despite the central portion being bowed outwardly into contact with the longitudinal side 14 of the concrete form 12.

In typical concrete slab construction, multiple placement apparatuses 10 are attached to the common longitudinal side 14 of the concrete form 12. In this respect, in addition to the base members 16 being centrally positioned on the longitudinal side 14 in the aforementioned manner, the base members 16 are preferably oriented in equidistantly spaced intervals from each other. Such spacing is typically accomplished by aligning the third locator peg 48 of each base member 16 with a respective secondary chalk line L1 applied to the top lateral edge 15 of the concrete form 12. Subsequent to the attachment of the base members 16 to the concrete form 12, the sheaths 58 of the placement apparatuses 10 are advanced over the outer sleeves 18 of respective ones of the base members 16.

After the sheaths 58 have been advanced over the base members 16, a first pour of concrete is made about the sheaths 58. The bond between the concrete of the first pour and the sheaths 58 is enhanced by the raised ribs 74 formed on the outer surfaces of the longitudinal and lateral sides 66, 68 thereof. Subsequent to the curing and hardening of the first concrete pour into a first concrete slab, the concrete form 12 is stripped away from the edge of the first concrete slab, thus causing the outer sleeves 18 of the base members 16 to be removed from within the interior compartments 64 of respective ones of the sheaths 58. As will be recognized, the base members 16 remain in attachment to the concrete form 12 when the same is stripped away from the first concrete slab. The removal of the concrete form 12 from the first concrete slab exposes the open proximal ends 60 of the sheaths 58 which are embedded within the edge of the first concrete slab.

Referring now to FIGS. 6 and 7, subsequent to the removal of the concrete form 12 (and hence the base members 16) from the first concrete slab, elongate dowel rods 76 having generally square cross-sectional configurations are advanced into the interior compartments 64 of respective ones of the sheaths 58 via the exposed open proximal ends 60 thereof. The advancement of each dowel rod 76 into a respective interior compartment 64 is limited by the abutment of the distal end thereof against the stop members 72. As such, the distal end of each dowel rod 76 is maintained in spaced relation to the closed distal end 62 of a respective sheath 58 when fully inserted into the interior compartment 64 thereof. As seen in FIG. 7, when the dowel rod 76 is fully inserted into the interior compartment 64 of the sheath 58, the dowel rod 76 extends between the crush ribs 70 and the inner surfaces of the longitudinal sides 66. Additionally, a substantial portion of the length of the dowel rod 76 protrudes from the open proximal end 60 of the sheath 58.

Subsequent to the insertion of the dowel rods 76 into the interior compartments 64 of the sheaths 58, a generally U-shaped sealing clip 78 is placed over each dowel rod 76. In this respect, the sealing clip 78 defines a generally square notch 80 having a configuration which is complementary to that of the dowel rod 76. Importantly, the sealing clip 78 is placed over the dowel rod 76 in a manner wherein the same covers those portions of the open proximal end 60 of the sheath 58 which extend between the opposed, vertically oriented sides of the dowel rod 76 and the lateral sides 68 of the sheath 58.

After the sealing clips 78 have been placed upon the dowel rods 76 in the aforementioned manner, a second pour of concrete is then made about the exposed portions of the dowel rods 76. As will be recognized, the concrete of the second pour is prevented from flowing into the interior compartments 64 of the sheaths 58 by the sealing clips 78 placed over the dowel rods 76. The curing and hardening of the second concrete pour facilitates the formation of a second concrete slab, with the dowel rods 76 extending from the second concrete slab into the interior compartments 64 of the sheaths 58 embedded within the first concrete slab, and thus extending through the cold joint defined between the first and second concrete slabs. The extension of the dowel rods 76 into the sheaths 58 allows for movement of the first and second concrete slabs toward and away from each other. In this respect, movement of the first and second concrete slabs toward each other is permitted by the movement of the dowel rods 76 distally within the interior compartments 64 toward the closed distal ends 62 of the sheaths 58. Due to their relatively small size, the stop members 72 lack the structural integrity needed to resist such distal movement of the dowel rods 76. Conversely, movement of the first and second concrete slabs away from each other is permitted by the proximal movement of the dowel rods 76 within the interior compartments 64 of the sheaths 58.

Due to the horizontally oriented top and bottom sides of the dowel rods 76 being in direct contact with the longitudinal sides 66 of the sheaths 58, vertical movement of the first and second concrete slabs relative to each other is substantially prevented. However, the first or second concrete slab may move horizontally relative to each other, with such movement being facilitated by the collapse of either of the crush ribs 70 which allows for the lateral movement of the dowel rod 76 within the interior compartment 64 of the sheaths 58.

Referring now to FIGS. 8–12, there is depicted a concrete dowel placement apparatus 82 constructed in accordance with a second embodiment of the present invention. Like the placement apparatus 10 of the first embodiment previously described, the placement apparatus 82 comprises a base member 84 which is preferably fabricated from a plastic material. As seen in FIGS. 8–11, the base member 84 itself comprises an outer sleeve 86 which has a generally circular cross-sectional configuration and defines a proximal first end 88 and a distal second end 90.

As best seen in FIGS. 8–10, integrally connected to and extending about the first end 88 of the outer sleeve 86 is a flange portion 92 which defines a front surface 94, a substantially flat back surface 96, an a continuous peripheral edge 98. The flange portion 92 has a generally circular configuration including a flat portion 98*a* within the peripheral edge 98 thereof. Formed on the back surface 96 of the flange portion 92 is a raised bead 100 which extends about the peripheral edge 98. Additionally, formed on the front surface 94 of the flange portion 92 about the first end 88 of the outer sleeve 86 is a reinforcement region 102 of increased thickness.

As seen in FIGS. 8, 10 and 11, disposed within the outer sleeve 86 in equidistantly spaced intervals of approximately ninety degrees are four (4) slots 104 which extend longitudinally from the second end 90 of the outer sleeve 86 to the first end 88 thereof (i.e., to the reinforcement region 102 of the flange portion 92). Additionally, formed on the outer surface of the outer sleeve 86 are four (4) elongate ribs 106 which are separated from each other by equidistantly spaced intervals of approximately ninety degrees and extend longitudinally from the reinforcement region 102 to approximately the center of the outer sleeve 86. In this respect, each of the ribs 106 extends along a respective one of the slots 104. As best seen in FIG. 10, the second end 90 of the outer sleeve 86 is preferably formed to have a slightly tapered or beveled configuration.

As seen in FIGS. 8 and 10, formed on the front surface 94 of the flange portion 92 adjacent the peripheral edge 98 is a first locator peg 108 and a second locator peg 110. The first and second locator pegs 108, 110 are oriented upon an axis which extends in generally perpendicular relation to the axis of the outer sleeve 86 and in generally parallel relation to the flat portion 98*a* of the peripheral edge 98.

The base member 84 of the placement apparatus 82 further comprises an inner sleeve 112 which has a generally circular cross-sectional configuration and is concentrically positioned within the outer sleeve 86. In this respect, the inner sleeve 112 is disposed in spaced relation to the surrounding outer sleeve 86. The inner sleeve 112 defines an aperture 114 which extends longitudinally therethrough to the back surface 96 of the flange portion 92. Additionally, the inner sleeve 112 is sized such that the aperture 114 extends to the second end 90 of the outer sleeve 86. As best seen in FIG. 11, extending between the inner sleeve 112 and the outer sleeve 86 in equidistantly spaced intervals of approximately ninety degrees are four (4) reinforcement walls 116. The reinforcement walls 116, which are arranged in a generally cross-shaped pattern, are each centrally positioned between a respective pair of the slots 104. As such, the reinforcement walls 116 are off-set from the slots 104 by approximately forty-five degrees. Both the inner sleeve 112 and reinforcement walls 116, like the outer sleeve 86, are integrally connected to the flange portion 92.

Referring now to FIGS. 8 and 12, in addition to the base member 84, the placement apparatus 82 of the second embodiment further comprises an elongate dowel receiving sheath 118 which has a generally circular cross-sectional configuration and includes an open proximal end 120, a closed distal end 122, and a hollow interior compartment 124 extending longitudinally therein. As seen in FIG. 12, formed on the inner surface of the sheath 18 in opposed relation to each other and in relative close proximity to the closed distal end 122 is a pair of stop members 126. The sheath 118 further includes raised ribs 128 formed on the outer surface of a substantial portion thereof. However, the outer surface of the sheath 118 adjacent its open proximal end 120 is devoid of the ribs 128 and has a generally smooth configuration. The sheath 118, like the base member 84, is preferably fabricated from a plastic material.

In the placement apparatus 82, the sheath 118 is extensible over the outer sleeve 86 of the base member 84 such that at least a portion of the outer sleeve 86 resides within the interior compartment 124 of the sheath 118. In this respect, the interior compartment 124 has a configuration which is complementary to that of the outer sleeve 86, thus allowing the open proximal end 120 of the sheath 118 to be slidably advanced over the outer sleeve 86. The advancement of the sheath 118 over the outer sleeve 86 is aided by the tapered configuration of the second end 90 of the outer sleeve 86. Typically, the sheath 118 is advanced over the outer sleeve 86 until such time as the open proximal end 120 is abutted against the front surface 94 of the flange portion 92, and more particularly the reinforcement region 102 circumventing the first end 88 of the outer sleeve 86.

Once attached to the base member 84 in the aforementioned manner, the sheath 118 is frictionally maintained thereon, with such frictional retention being aided by the interference of the ribs 106 of the outer sleeve 86 with the inner surface of the sheath 118 defining the interior compartment 124 thereof. Additionally, the inclusion of the slots 104 within the outer sleeve 86 allows the arcuate sections of the outer sleeve 86 defined by the slots 104 to flex slightly inwardly toward each other when the sheath 118 is advanced thereover. In this respect, the outward biasing force exerted by the inwardly flexed arcuate sections of the outer sleeve 86 against the sheath 118 further assists in the frictional retention of the sheath 118 upon the outer sleeve 86 of the base member 84.

The placement apparatus 82 of the second embodiment is used in a similar manner to that previously described in relation to the placement apparatus 10 of the first embodiment. In this respect, the base member 84 is initially secured to the longitudinal side 14 of the concrete form 12. Prior to such attachment, the base member 84 is "centered" upon the longitudinal side 14, with such centering being accomplished by aligning the first and second locator pegs 108, 110 with the chalk line L applied to and longitudinally bisecting the longitudinal side 14 of the concrete form 12. Once the base member 84 has been centered upon the longitudinal side 14, a fastener such as a nail is extended through the aperture 114 of the inner sleeve 112 and into the wooden concrete form 12. Due to the inner sleeve 112 being concentrically positioned within and spaced from the outer sleeve 86, any blunting of the distal end of the inner sleeve 112 which occurs as the nail is being driven into the concrete form 12 does not result in any distortion of the outer sleeve 86 as would adversely affect the ability to slidably advance the sheath 118 thereover. The reinforcement walls 116 assist in maintaining the structural integrity of the base member 84 as the nail is driven into the concrete form 12.

In the placement apparatus 82, both the base member 84 and sheath 118 are preferably fabricated via an injection molding process. Due to such method of fabrication, it is difficult to form the back surface 96 of the flange portion 92 with a perfectly flat configuration. As such, the inclusion of the raised bead 100 upon the back surface 96 about the peripheral edge 98 assists in achieving substantial abutting contact between the base member 84 and the concrete form 12 when the base member 84 is initially oriented upon the longitudinal side 14 along the chalk line L. When the raised bead 100 is initially placed against the longitudinal side 14, the back surface 96 of the flange portion 92 is disposed in spaced relation to the longitudinal side 14. The extension of the nail through the aperture 114 and into the concrete form 12 in the aforementioned manner causes the central portion of the back surface 96 of the flange portion 92 to be bowed outwardly into contact with the longitudinal side 14 of the concrete form 12. Thus, even if the back surface 96 is not substantially flat, the flange portion 92 will have at least two points of contact with the longitudinal side 14 of the concrete form 12 when the base member 84 is secured thereto (i.e., the raised bead 100 and the outwardly bowed center region of the back surface 96). The inclusion of the reinforcement region 102 in the flange portion 92 maintains the structural integrity of the base member 84 despite the central portion being bowed outwardly into contact with the longitudinal side 14 of the concrete form 12. Additionally, the inclusion of the flat portion 98a within the peripheral edge 98 allows the base member 84 to be centered upon the longitudinal side 14 without any portion of the flange portion 92 protruding beyond the top and bottom lateral edges of the concrete form 12.

In typical concrete slab construction, the placement apparatus 82 of the second embodiment is used in substantially the same manner as previously described in relation to the placement apparatus 10 of the first embodiment. In this respect, multiple placement apparatuses 82 are attached to the common longitudinal side 14 of the concrete form 12 in equidistantly spaced relation to each other. More particularly, subsequent to the attachment of the base members 84 to the concrete form 12, the sheaths 118 of the placement apparatuses 82 are advanced over the outer sleeves 86 of respective ones of the base members 84. After the sheaths 118 have been advanced over the base members 84, a first pour of concrete is made about the sheaths 118. The bond between the concrete of the first pour and the sheaths 118 is enhanced by the raised ribs 128 formed on the outer surfaces thereof. Subsequent to the curing and hardening of the first concrete pour into a first concrete slab, the concrete form 12 is stripped away from the edge of the first concrete slab, thus causing the outer sleeves 86 of the base members 84 to be removed from within the interior compartments 124 of respective ones of the sheaths 118. The base members 84 remain in attachment to the concrete form 12 when the same is stripped away from the first concrete slab. The removal of the concrete form 12 from the first concrete slab exposes the open proximal ends 120 of the sheaths 118 which are embedded within the first concrete slab.

Referring now to FIG. 12, subsequent to the removal of the concrete form 12 (and hence the base members 84) from the first concrete slab, elongate dowel rods 130 having generally circular cross-sectional configurations are advanced into the interior compartments 124 of respective ones of the sheaths 118 via the exposed open proximal ends 120 thereof. The advancement of each dowel rod 130 into a respective interior compartment 124 is limited by the abutment of the distal end thereof against the stop members 126. As such, the distal end of each dowel rod 130 is maintained in spaced relation to the closed distal end 122 of a respective sheath 118 when fully inserted into the interior compartment 124 thereof. A substantial portion of the length of the dowel rod 130 protrudes from the open proximal end 120 of the sheath 118.

Subsequent to the insertion of the dowel rods 130 into the interior compartments 124 of the sheaths 118, a second pour of concrete is made about the exposed portions of the dowel rods 130. Due to the outer diameters of the dowel rods 130 being substantially equal to the diameters of the interior compartments 124, the concrete of the second pour is substantially prevented from flowing into the interior compartments 124 of the sheaths 118. The curing and hardening of the second concrete pour facilitates the formation of a second concrete slab, with the dowel rods 130 extending from the second concrete slab into the interior compartments 124 of the sheaths 118 embedded within the first concrete slab, and thus extending through the cold joint defined between the first and second concrete slabs. The extension of the dowel rods 130 into the sheaths 118 allows for the movement of the first and second concrete slabs toward and away from each other. In this respect, movement of the first and second concrete slabs toward each other is permitted by the movement of the dowel rods 130 distally within the interior compartments 124 toward the closed distal ends 122 of the sheaths 118. Due to their relatively small size, the stop members 126 lack the structural integrity needed to resist such distal movement of the dowel rods 130. Conversely, movement of the first and second concrete slabs away from each other is permitted by the proximal movement of the dowel rods 130 within the interior compartments 124 of the sheaths 118. Vertical and horizontal movement of the first and second concrete slabs relative to each other is substantially prevented by the interference between the dowel rods 130 and the sheaths 118.

Figure 13:
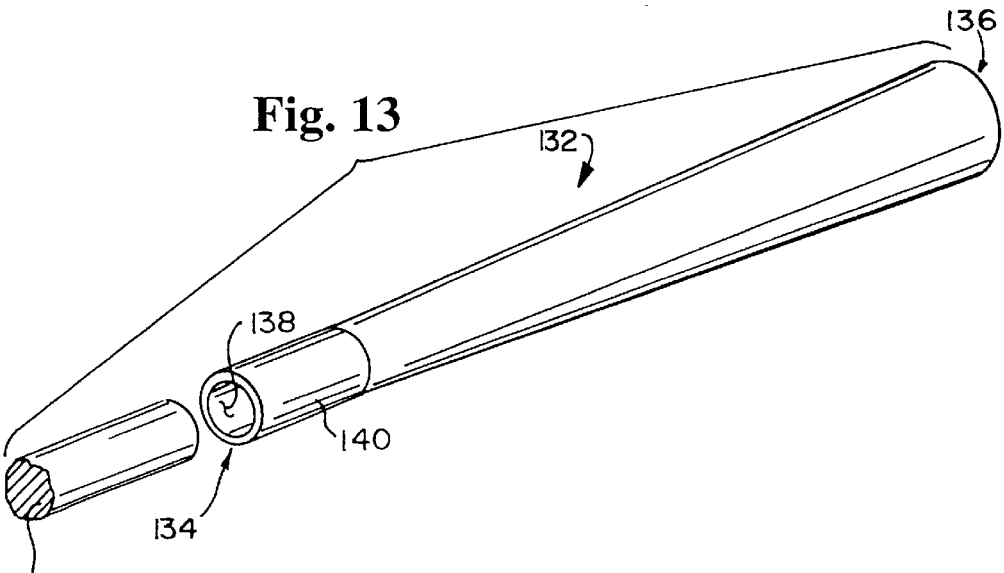
FIG. 13 is an exploded view of a concrete dowel placement apparatus constructed in accordance with a third embodiment of the present invention.
Figure 14:
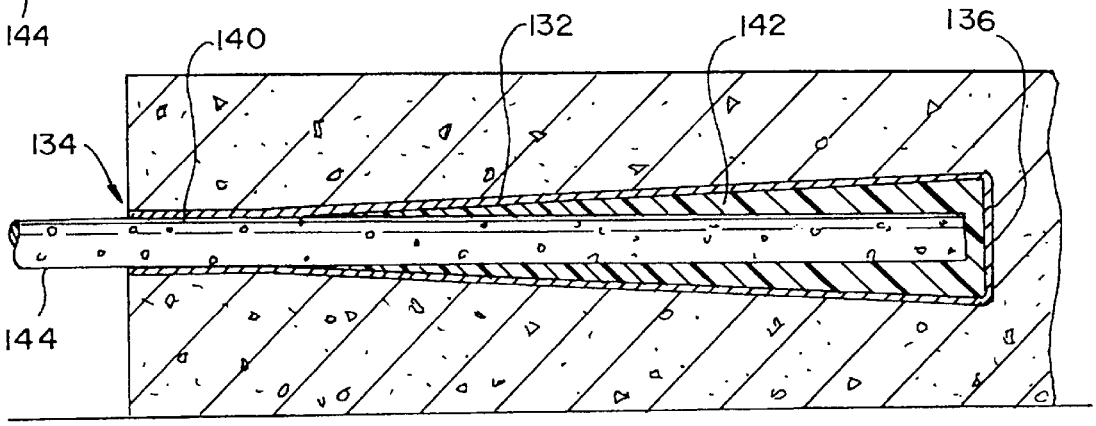
FIG. 14 is a cross-sectional view illustrating the manner in which the placement apparatus of the third embodiment shown in FIG. 13 is embedded within a concrete slab.

Referring now to FIGS. 13 and 14, there is depicted the dowel receiving sheath 132 of a concrete dowel placement apparatus constructed in accordance with a third embodiment of the present invention. The sheath 132 has a generally circular cross-sectional configuration and includes an open proximal end 134, a closed distal end 136, and a hollow interior compartment 138 extending longitudinally therein. The sheath 132 defines a proximal portion 140 which is adjacent the open proximal end 134 and is of substantially constant diameter. In this respect, the sheath 132, and hence the interior compartment 138, is of gradually increasing diameter as it extends distally from the proximal portion 140 to the closed distal end 136. The sheath 132 is preferably fabricated from steel, and more particularly stainless steel.

In the placement apparatus constructed in accordance with the third embodiment of the present invention, the sheath 132 is preferably used in conjunction with the previously described base member 84 of the placement apparatus 82 of the second embodiment. In this respect, the sheath 132 is extensible over the outer sleeve 86 of the base member 84 such that at least a portion of the outer sleeve 86 resides within the interior compartment 138 of the sheath 132. As will be recognized, the outer sleeve 86 will reside within that portion of the interior compartment 138 defined by the proximal portion 140 of the sheath 132. This proximal portion of the interior compartment 138 has a configuration which is complementary to that of the outer sleeve 86, thus allowing the open proximal end 134 of the sheath 132 to be slidably advanced over the outer sleeve 86. Once attached to the base member 84, the sheath is frictionally maintained thereon by the ribs 106 and inward flexion of the arcuate sections of the outer sleeve 86 defined by the slots 104 as previously discussed in relation to the placement apparatus 82 of the second embodiment.

Referring now to FIG. 14, the placement apparatus of the third embodiment is used by initially securing the base members 84 to the longitudinal side 14 of the concrete form 12 in the same manner previously described in relation to the placement apparatus 82. Subsequent to the attachment of the base members 84 to the concrete form 12, the sheaths 132 are advanced over the outer sleeves 86 of respective ones of the base members 84. After the sheaths 132 have been attached to the base members 84, a first pour of concrete is made about the sheaths 132. Subsequent to the curing and hardening of the first concrete pour into a first concrete slab, the concrete form 12 is stripped away from the edge of the first concrete slab, thus causing the outer sleeves 86 of the base members 84 to be removed from within the interior compartments 138 of respective ones of the sheaths 132.

Subsequent to the removal of the concrete form 12 (and hence the base members 84) from the first concrete slab, an epoxy, grout or other suitable bonding agent 142 is injected into the interior compartments of the sheaths 132. Thereafter, dowel rods 144 having generally circular cross-sectional configurations are advanced into the interior compartments 138 of respective ones of the sheaths 132 via the exposed open proximal ends 134 thereof. As the dowel rods 144 are advanced into the interior compartments 138, excess bonding agent 142 seeps from the open proximal ends 134 of the sheaths 132. A substantial portion of the length of each dowel rod 144 protrudes from the open proximal end 134 of a respective sheath 132.

A second pour of concrete is then made about the exposed portions of the dowel rods 144. Due to the diameters of the dowel rods 144 being substantially equal to the diameters of the interior compartments 138 defined by the proximal portions 140 of the sheaths 132, the concrete of the second pour is substantially prevented from flowing into the interior compartments 138 of the sheaths 132. The curing and hardening of the second concrete pour facilitates the formation of a second concrete slab, with the dowel rods 144 extending from the second concrete slab into the cured bonding agent 142 within the interior compartments 138 of the sheaths 132 embedded within the first concrete slab. As such, the dowel rods 144 extend through the cold joint defined between the first and second concrete slabs. Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A concrete dowel placement apparatus, comprising:

a base member comprising:

an outer sleeve having first and second ends;

a flange portion extending about the first end of the outer sleeve and defining a front surface, a back surface, and a peripheral edge;

an inner sleeve disposed within the outer sleeve, said inner sleeve defining an aperture which extends longitudinally therethrough to the back surface of the flange portion; and at least one reinforcement wall extending between the inner and outer sleeves;

a dowel receiving sheath having an open proximal end, a closed distal end, and a hollow interior compartment extending longitudinally therein;

the open proximal end of the sheath being extensible over the outer sleeve such that at least a portion of the outer sleeve resides within the interior compartment.

2. The placement apparatus of claim 1 wherein said base member includes four reinforcement walls extending between the inner and outer sleeves.

3. The placement apparatus of claim 1 wherein said outer sleeve includes at least two slots disposed therein which extend longitudinally from the second end thereof.

4. The placement apparatus of claim 3 wherein the outer sleeve includes four slots disposed therein in equidistantly spaced relation to each other.

5. The placement apparatus of claim 3 wherein said sheath includes a pair of crush ribs extending longitudinally within the interior compartment thereof, said crush ribs being received into respective ones of the slots when the sheath is extended over the outer sleeve of the base member.

6. The placement apparatus of claim 1 wherein said outer sleeve defines an outer surface having a plurality of longitudinally extending ribs formed thereon for maintaining the sheath in frictional engagement to the base member when extended over the outer sleeve.

7. The placement apparatus of claim 1 wherein the base member further comprises a raised bead formed on the back surface of the flange portion about the peripheral edge thereof.

8. The placement apparatus of claim 7 wherein the back surface of the flange portion is substantially flat.

9. The placement apparatus of claim 1 wherein the base member further comprises a reinforcement region which is formed on the front surface of the flange portion about the first end of the outer sleeve.

10. The placement apparatus of claim 1 wherein said base member further comprises at least two locator pegs formed on the front surface of the flange portion adjacent the peripheral edge and on opposite sides of the outer sleeve.

11. The placement apparatus of claim 10 wherein said base member comprises three locator pegs which are spaced about the outer sleeve in intervals of approximately ninety degrees.

12. The placement apparatus of claim 1 wherein said base member further comprises a pair of apertures disposed within and extending through the flange portion on opposite sides of the outer sleeve.

13. The placement apparatus of claim 1 wherein said flange portion has a generally oval configuration.

14. The placement apparatus of claim 1 wherein said flange portion has a generally circular configuration including a flat portion formed in the peripheral edge thereof.

15. The placement apparatus of claim 1 wherein said sheath includes at least one stop member disposed within the interior compartment in close proximity to the closed distal end.

16. The placement apparatus of claim 15 wherein the sheath includes a pair of stop members disposed in opposed relation to each other.

17. The placement apparatus of claim 1 wherein the base member and the sheath are each fabricated from a plastic material.

18. The placement apparatus of claim 1 wherein the aperture extends to the second end of the outer sleeve, with the inner sleeve being spaced from the outer sleeve.

19. The placement apparatus of claim 1 wherein the inner sleeve has a generally circular cross-sectional configuration and the outer sleeve has a generally rectangular cross-sectional configuration defining four corner regions.

20. The placement apparatus of claim 19 wherein the inner sleeve is centrally positioned within the outer sleeve.

21. The placement apparatus of claim 20 wherein said base member includes four reinforcement walls extending in a generally X-shaped pattern between the inner sleeve and respective ones of the corner regions of the outer sleeve.

22. The placement apparatus of claim 21 wherein said outer sleeve defines opposed pairs of lateral and longitudinal sides having outer surfaces, and said base member further comprises:

a pair of slots disposed within respective ones of the lateral sides of the outer sleeve and extending longitudinally to the second end thereof;

a plurality of ribs formed on the outer surfaces of the lateral and longitudinal sides and extending longitudinally to the front surface of the flange portion;

a raised bead formed on the back surface of the flange portion about the peripheral edge thereof; and a reinforcement region formed on the front surface of the flange portion about the first end of the outer sleeve.

23. The placement apparatus of claim 22 wherein said base member further comprises:

first, second and third locator pegs formed on the front surface of the flange portion adjacent the peripheral edge, said first and second locator pegs being oriented upon a first axis which bisects the lateral sides of the outer sleeve and said third locator peg being oriented upon a second axis which bisects the longitudinal sides of the outer sleeve; and a pair of apertures disposed within and extending through the flange portion, said apertures being oriented upon the first axis between the lateral sides of the outer sleeve and respective ones of the first and second locator pegs.

24. The placement apparatus of claim 22 wherein the flange portion has a generally oval configuration with the back surface thereof being substantially flat.

25. The placement apparatus of claim 22 wherein said sheath comprises:

a pair of crush ribs extending longitudinally within the interior compartment in opposed relation to each other; and an opposed pair of stop members disposed within the interior compartment in close proximity to the closed distal end;

said crush ribs being received into respective ones of the slots when the sheath is extended over the outer sleeve of the base member.

26. The placement apparatus of claim 1 wherein the inner and outer sleeves each have generally circular cross-sectional configurations.

27. The placement apparatus of claim 26 wherein the inner sleeve is concentrically positioned within the outer sleeve.

28. The placement apparatus of claim 27 wherein said base member includes four reinforcement walls extending between the inner and outer sleeves at intervals of approximately ninety degrees.

29. The placement apparatus of claim 28 wherein the outer sleeve defines an outer surface, and said base member further comprises:

four slots disposed within the outer sleeve and extending longitudinally to the second end thereof in equidistantly spaced intervals of approximately ninety degrees, each of said slots being centrally positioned between a respective pair of said reinforcement walls;

a plurality of ribs formed on the outer surface of the outer sleeve and extending longitudinally to the front surface of the flange portion;

a raised bead formed on the back surface of the flange portion about the peripheral edge thereof; and a reinforcement region formed on the front surface of the flange portion about the first end of the outer sleeve.

30. The placement apparatus of claim 29 wherein said base member further comprises a pair of locator pegs formed on the front surface of the flange portion adjacent the peripheral edge and on opposite sides of the outer sleeve.

31. The placement apparatus of claim 29 wherein the flange portion has a generally circular configuration including a flat portion formed in the peripheral edge thereof, with the back surface being substantially flat.

32. The placement apparatus of claim 29 wherein the sheath has a generally circular cross-sectional configuration and is of gradually increasing diameter as it extends from the open proximal end to the closed distal end.

33. The placement apparatus of claim 1 wherein the sheath has a generally circular cross-sectional configuration and is of gradually increasing diameter as it extends from the open proximal end to the closed distal end.

34. The placement apparatus of claim 33 wherein said sheath is fabricated from steel.

35. A method of extending a dowel rod through a joint between adjacent concrete slabs, comprising the steps of:

(a) providing a base member which comprises:

(i) an outer sleeve having first and second ends;

(ii) a flange portion extending about the first end of the outer sleeve and defining a front surface, a back surface, and a peripheral edge;

(iii) an inner sleeve disposed within the outer sleeve, said inner sleeve defining an aperture which extends longitudinally therethrough to the back surface of the flange portion; and (iv) at least one reinforcement wall extending between the inner and outer sleeves;

(b) attaching the base member to a concrete form such that the outer sleeve protrudes therefrom;

(c) providing a sheath which includes an open proximal end, a closed distal end, and a hollow interior compartment extending longitudinally therein;

(d) extending the open proximal end of the sheath over the outer sleeve of the base member such that at least a portion of the outer sleeve resides within the interior compartment;

(e) making a first pour of concrete within the concrete form about the sheath;

(f) removing the outer sleeve of the base member from within the sheath subsequent to the curing of the first pour; and (g) inserting the dowel rod into the open proximal end of the sheath.

36. The method of claim 35 wherein step (b) comprises (1) placing the back surface of the flange portion into abutting contact with the concrete form; and (2) extending a fastener through the aperture of the inner sleeve and into the concrete form.

37. The method of claim 35 further comprising the step of:

(h) making a second pour of concrete within the concrete form about the exposed portion of the dowel rod protruding from the open proximal end of the sheath.

38. The method of claim 35 wherein step (g) further comprises placing a generally U-shaped sealing clip over the dowel rod in a manner covering the open proximal end of the sheath.

* * * * *